US011629853B1

(12) United States Patent
Wong et al.

(10) Patent No.: US 11,629,853 B1
(45) Date of Patent: Apr. 18, 2023

(54) LIGHTING DEVICE SYSTEM WITH BIASING DEVICE AND DRIVER ELECTRONICS BRACKET

(71) Applicant: Troy-CSL Lighting Inc., City of Industry, CA (US)

(72) Inventors: Calvin Wong, Diamond Bar, CA (US); Jacob Hawkins, Sierra Madre, CA (US)

(73) Assignee: Troy-CSL Lighting Inc., City of Industry (CA)

( * ) Notice: Subject to any disclaimer, the term of this patent is extended or adjusted under 35 U.S.C. 154(b) by 0 days.

(21) Appl. No.: 17/724,338

(22) Filed: Apr. 19, 2022

(51) Int. Cl.

| | |
|---|---|
| ***F21V 29/73*** | (2015.01) |
| ***F21V 29/76*** | (2015.01) |
| ***F21V 29/508*** | (2015.01) |
| ***F21V 23/00*** | (2015.01) |

(52) U.S. Cl.
CPC ..... *F21V 29/73* (2015.01); *F21V 23/009* (2013.01); *F21V 29/508* (2015.01); *F21V 29/76* (2015.01)

(58) Field of Classification Search
CPC ..... F21V 29/508; F21V 29/73; F21V 29/76; F21V 23/009
See application file for complete search history.

(56) References Cited

U.S. PATENT DOCUMENTS

2009/0290343 A1* 11/2009 Brown ..... F21K 9/00 362/294
2012/0092860 A1* 4/2012 Blackstone ..... H05K 5/00 362/221
2013/0272003 A1* 10/2013 Miletich ..... F21V 23/007 362/382
2018/0100641 A1* 4/2018 Verfuerth ..... F21V 3/00
2020/0363042 A1* 11/2020 Jeswani ..... F21V 21/04

* cited by examiner

*Primary Examiner* — Thomas M Sember
(74) *Attorney, Agent, or Firm* — Foley & Lardner LLP

(57) ABSTRACT

A lighting device system includes a lighting device module having a module housing configured to be selectively inserted through an opening in a panel or a base. Driver electronics are configured to be electrically coupled to the lighting device module. A heat sink member is located adjacent the opening in the panel or the base. A movable biasing device has a first position to apply a bias force on the module housing, pressing the module housing toward the heat sink member to increase thermal transfer. The moveable biasing device has a second position to provide improved access to the driver electronics through the opening in the panel or base relative to the first position. The movable biasing device is selectively moveable from the first position to the second position, or from the second position to the first position.

19 Claims, 6 Drawing Sheets

LIGHTING DEVICE SYSTEM WITH BIASING DEVICE AND DRIVER ELECTRONICS BRACKET

BACKGROUND

Certain lighting devices such as, but not limited to, room or area lighting devices, can include configurations that allow for mounting of the lighting device in a recess in a ceiling, wall or other structure. In certain contexts, it can be desirable to mount the lighting device system behind a panel of the ceiling, wall or other structure, and reduce or minimize the size of an opening through the panel for passing light from the lighting device.

Lighting devices include a light source, such as a light emitting diode (LED). Typically, the brightness of an LED light source is at least partially related to the speed in which heat can be transferred away from the LED component. For example, it may be desirable to maintain the temperature of the LED under about 105° Celsius for improved or maximum light output and efficiency. However, in contexts in which the lighting device is mounted in a ceiling, wall or other object (for example, as a recessed lighting device), the LED component may be located within an enclosed or poorly ventilated environment within the ceiling, wall or other object, which can inhibit the ability to transfer heat away from the LED. In addition, in contexts in which the lighting device is mounted in a ceiling, wall or other object (for example, as a recessed lighting device, it may be desirable to have access to components of the lighting device, during or after mounting the lighting device (e.g., in a plenum, attic space, wall space or other volume space in the ceiling, wall or other object).

Accordingly, various lighting device and system examples described herein can be configured to provide one or more (or each) of: efficient transfer and dissipation of heat away from the LED; ease of accessibility to components located in a ceiling, wall or other object; or ability to mount components and pass light through a relatively small opening in a ceiling, wall or other object.

SUMMARY

An example of a lighting device system includes at least one lighting device module, having a module housing configured to be selectively inserted into an installed state, at least partially through an opening in a panel or a base. Driver electronics are configured to be electrically coupled to the at least one lighting device module to provide electrical power to the at least one lighting device module. The system includes at least one heat sink member having a contact surface, where the at least one heat sink member is located adjacent the opening in the panel or the base. The system further includes at least one movable biasing device having a first position to apply a bias force on the at least one module housing, the bias force pressing the at least one module housing toward the contact surface of the at least one heat sink member to increase thermal transfer between the at least one module housing and the contact surface when the at least one module housing is inserted in the installed state, the at least one biasing device having a second position to provide improved access to the driver electronics through the opening in the panel or base relative to the first position. The at least one movable biasing device is selectively moveable from the first position to the second position, or from the second position to the first position.

In further examples, the at least one movable biasing device includes a moveable biasing member configured to apply the bias force, and a mounting bracket for holding the driver electronics. The biasing member is arranged between the opening and the mounting bracket when the at least one movable biasing device is in the first position. In addition, the biasing member is arranged in a location that is not between the opening and the mounting bracket when the at least one movable biasing device is in the second position.

In further examples, the lighting device system further includes at least one arm, where each arm is pivotally connected to the mounting bracket at a first pivot joint, and pivotally connected to the biasing member at a second pivot joint that is separated from the first pivot joint by a length portion of the arm.

In further examples, the biasing member is pivotally connected to the at least one heat sink member at a third pivot joint that is separated from the first pivot joint and from the second pivot joint.

In further examples, the mounting bracket is configured to connect to the panel or the base for sliding movement between a first bracket position and a second bracket position as the at least one movable biasing device is moved between the first position and the second position, respectively, and the mounting bracket is located closer to the opening in the second bracket position relative to the first bracket position.

In further examples, the lighting device system further includes at least one rail on the panel or the base, wherein the mounting bracket has at least one flange that is held by the rail for sliding movement between the first bracket position and the second bracket position.

In further examples, the lighting device system further includes a pair of rails on the panel or the base, wherein the mounting bracket has a pair of flanges that are held by the rails for sliding movement between the first bracket position and the second bracket position.

In further examples, the at least one movable biasing device comprises a biasing member configured to apply the bias force, the biasing member having a curved surface that matches a curved outer surface of the at least one lighting device module such that the at least one lighting device module fits at least partially within the curved surface of the biasing member when the biasing member applies the bias force.

In further examples, the at least one lighting device module includes a module housing having an inner volume and an axial dimension, a moveable heat sink member, and a light source coupled to the moveable heat sink member for movement with the moveable heat sink member. The movable heat sink member is supported within the inner volume of the module housing for movement through a range of positions to selectively change an angle at which the light source is directed relative to the axial dimension of the module housing.

In further examples, the lighting device system further includes at least one angle indicator that provides a visual indication of the angle at which the light source is directed relative to the axial dimension of the module housing.

In further examples, the at least one angle indicator includes at least one slot shaped opening on the module housing through which at least a portion of the moveable heat sink member is viewable through the range of positions of the moveable heat sink member.

In further examples, the moveable heat sink member is supported for movement along a curved path of motion, and the at least one slot shaped opening includes a curved slot having a curvature that matches the curved path of motion.

In further examples, the lighting device system further includes indicia on or adjacent the at least one slot shaped opening that identifies multiple possible angles within a range of angles corresponding to the range of positions of the moveable heat sink member.

In further examples, the module housing includes at least one rail within the inner volume, and the moveable heat sink member has at least one groove or channel that receives the at least one rail and is slidable along the at least one rail through the range of positions to selectively change the angle at which the light source is directed relative to the axial dimension of the module housing.

In further examples, the at least one rail has an arch shape to guide the movable heat sink member in an arch-shaped path of movement.

Further examples relate to a lighting device system that includes at least one lighting device module having a module housing configured to be selectively inserted into an installed state, at least partially through an opening in a panel or a base, driver electronics configured to be electrically coupled to the at least one lighting device module to provide electrical power to the at least one lighting device module, and a mounting bracket. The mounting bracket has a receptacle holding the driver electronics, and is configured to connect to the panel or the base for selective sliding movement between a first bracket position and a second bracket position. The receptacle of the mounting bracket is located closer to the opening in the second bracket position relative to the first bracket position to allow or improve access to the driver electronics.

In further examples, the lighting device system further includes a moveable biasing member having a first position to apply a bias force on the at least one module housing when the at least one module housing is inserted in the installed state. The movable biasing member is arranged between the opening and the mounting bracket when the at least one movable biasing device is in the first position. In addition, the moveable biasing member is arranged in a location that is not between the opening and the mounting bracket when the at least one movable biasing device is in the second position.

In further examples, the lighting device system further includes at least one heat sink member having a contact surface. The at least one heat sink member is located adjacent the opening in the panel or the base. The bias force applied by the movable biasing member presses the at least one module housing toward the contact surface of the at least one heat sink member to increase thermal transfer between the at least one module housing and the contact surface when the at least one module housing is inserted in the installed state and the movable biasing member is in the first position.

In further examples, the lighting device system further includes at least one rail on the panel or the base. In addition, the mounting bracket has at least one flange that is held by the rail for sliding movement between the first bracket position and the second bracket position.

In further examples, the at least one lighting device module includes a moveable heat sink member, a light source coupled to the moveable heat sink member for movement with the moveable heat sink member, a module housing and at least one angle indicator. The module housing having an inner volume and an axial dimension. The moveable heat sink member is supported within the inner volume of the module housing for movement through a range of positions to selectively change an angle at which the light source is directed relative to the axial dimension of the module housing. The at least one angle indicator provides a visual indication of the angle at which the light source is directed relative to the axial dimension of the module housing.

BRIEF DESCRIPTION OF THE DRAWINGS

The above and other aspects and features of the present invention will become more apparent to those skilled in the art from the following detailed description of the example embodiments with reference to the accompanying drawings, in which.

DETAILED DESCRIPTION

Figure 1:
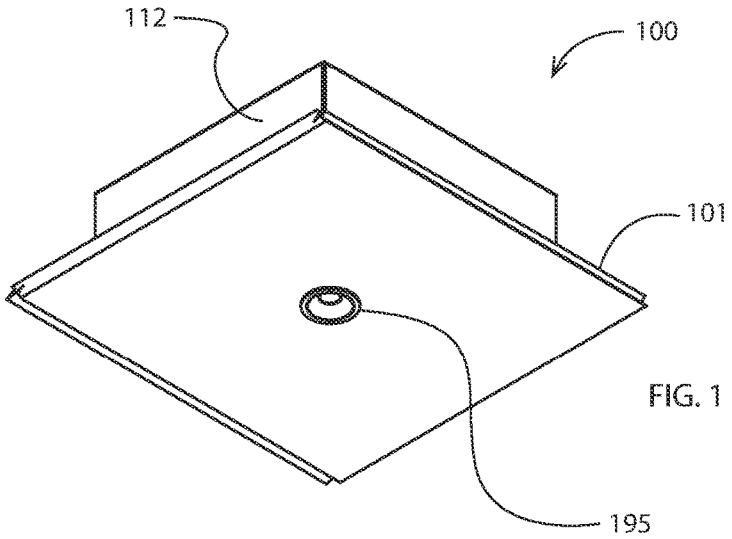
FIG. 1 is a perspective view of an example of a lighting device system.

Hereinafter, example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. Further, features or aspects within each example embodiment should typically be considered as available for other similar features or aspects in other example embodiments.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s)

as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," "coupled to," "secured to" or "attached to" another element or feature, it can be directly on, connected to, coupled to, secured to or attached to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," "generally" and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to various examples described herein, a lighting device system is configured as a concealed or a recessed lighting device for mounting in a ceiling, wall or other structure, by locating the lighting device within or behind a ceiling panel, wall panel or other structure. For example, the lighting device system may be configured to be installed in an opening to a plenum, duct or attic space of a ceiling, or in an inner wall space in a manner to appear flush or substantially flush with an exposed surface of a ceiling, wall or other object. In other examples, variations of the lighting device system may be configured to be installed in a manner that is not flush with an exposed surface (and, instead, are configured to be recessed in or protruding from the exposed surface of a ceiling, wall, outer housing or other object), or is configured to be surface-mounted on the exposed surface of the ceiling, wall, outer housing or other object. In yet other examples, variations of the lighting device system may be configured to be mounted on a support structure (such as, but not limited to a sconce structure, pedestal, shaft or the like).

The lighting device system includes a lighting device module having a light source and at least one optic member that are configured to emit light in a cone or other pattern. In examples in which the optic member(s) includes one or more lenses, the axis of the light emission may correspond to an optical axis of the one or more lenses. In other examples, the axis of the light emission may correspond to a center of the light cone or pattern emitted by the light source and optic member(s).

Certain examples are configured to provide sufficient thermal communication and heat dissipation characteristics to help maintain the temperature of the light source at or below a desired threshold temperature for improved operation. In addition to thermal communication, the lighting device system and the lighting module may be configured for ease of manufacture, assembly or servicing. In particular examples, the lighting device system and the lighting module may be configured to allow adjustment of a direction of light emission from the lighting module about multiple axis.

In particular examples, the lighting device system may be configured to emit light through a relatively small opening in a panel and (or base member), where that relatively small opening has a size and shape through which the lighting device module and the driver electronics may fit (for example, by installing or removing those components in or from the rest of the lighting device system). Accordingly, a single, relatively small opening can provide a light outlet opening, and also accommodate selective access to the lighting device module and (or) the driver electronics, without requiring removal of the rest of the lighting device system from an installed state.

Lighting Device System 100

FIG. 1 shows a perspective view of an example of a lighting device system 100, in an assembled state and attached to or installed on a panel 101 (e.g., as viewed from below the panel 101). In certain examples, the panel 101 is not part of the lighting device system 100, but represents a portion of a ceiling panel, a wall panel or a panel of another structure in which the lighting device system 100 is installed (or configured to be installed). In other examples, the panel 101 may be included as part of the lighting device system 100.

Figure 3:
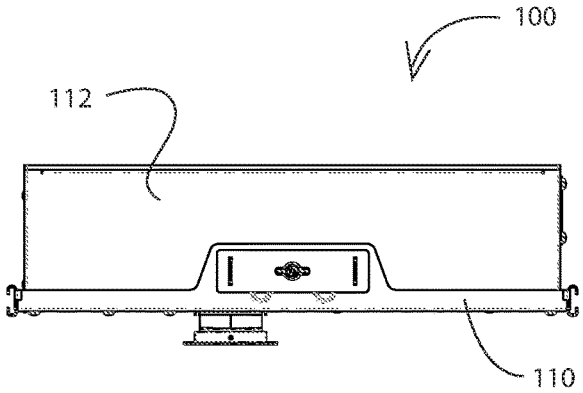
FIG. 3 is a side view of the lighting device system of FIG. 2, without the panel.
Figure 2:
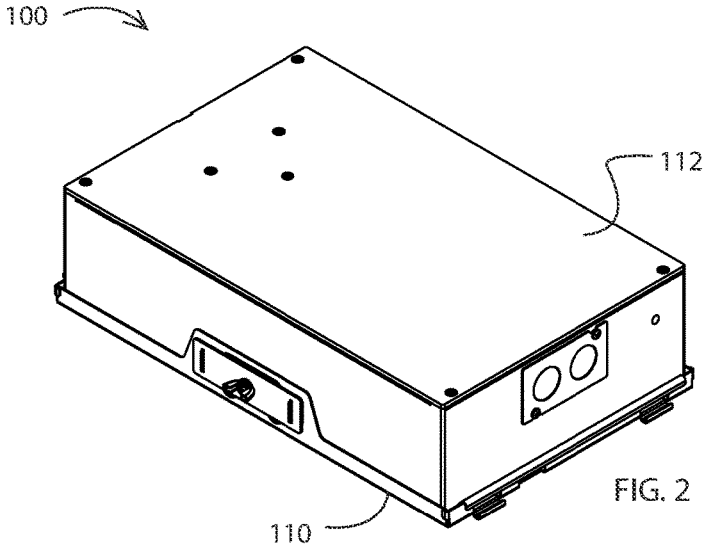
FIG. 2 is another perspective view of the example of the lighting device system of FIG. 1, without a panel.

FIG. 2 shows another perspective view of the assembled lighting device system 100, without the panel 101 (e.g., as viewed from above the system 100). A side view of the assembled lighting device system 100 is shown in FIG. 3.

Figure 4:
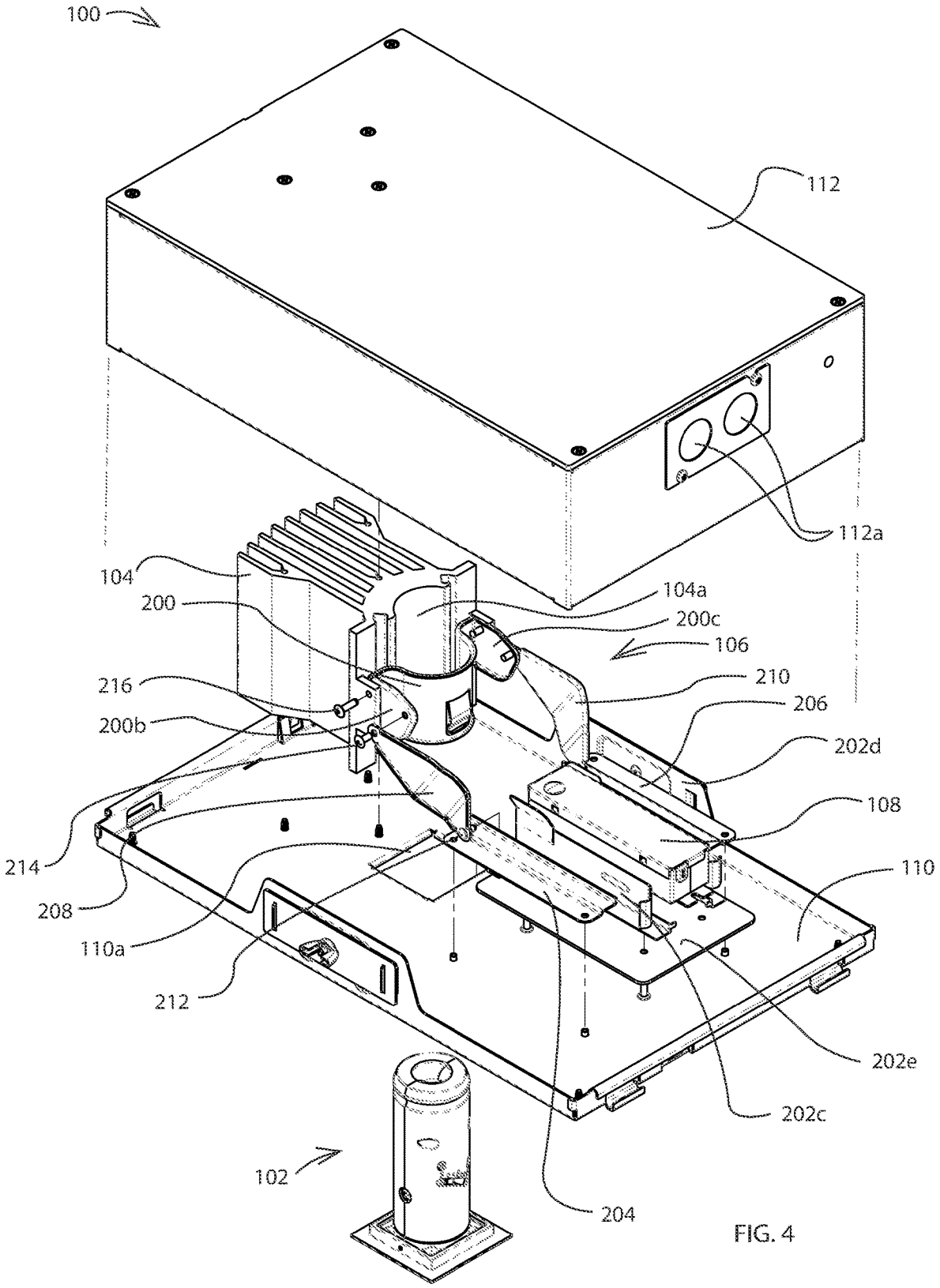
FIG. 4 is a partially exploded view of the lighting device system of FIG. 2.
Figure 5:
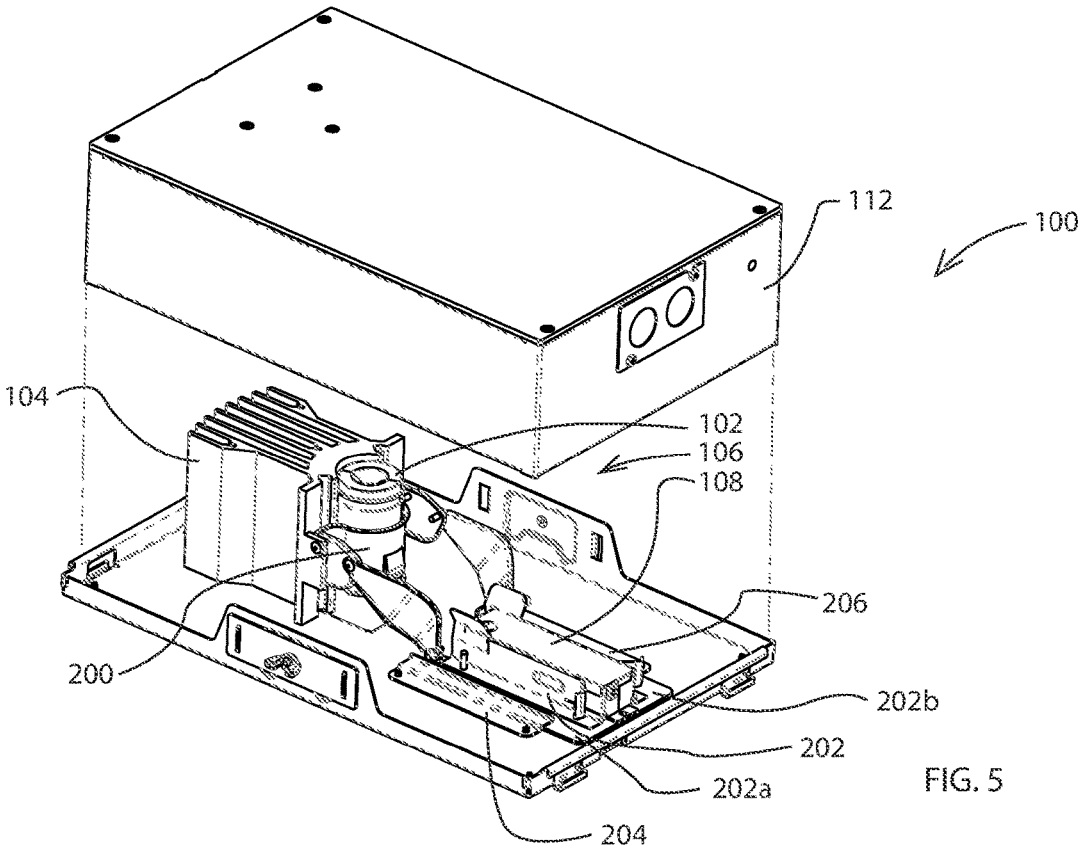
FIG. 5 is a perspective view of the lighting device system of FIG. 2, with the cover removed and the biasing device in a first position.
Figure 6:
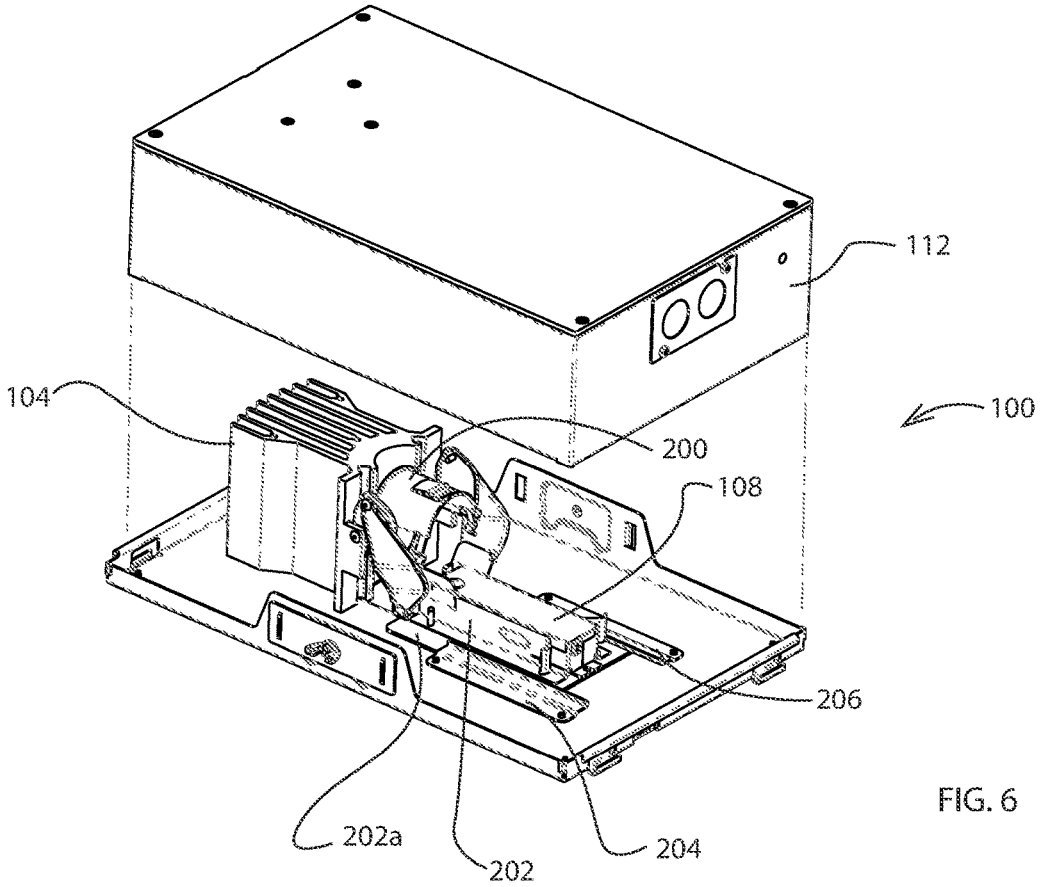
FIG. 6 is a perspective view of the lighting device system of FIG. 2, with the cover removed and the biasing device in a second position.

A partially exploded, perspective view of view of the same lighting device system 100, without the panel 101, is shown in FIG. 4. FIGS. 5 and 6 are perspective views of the same lighting device system 100, without the panel 101, and with a cover member separated from the rest of the system 100.

In the example of FIGS. 1-6, the lighting device system 100 includes a lighting device module 102, a heat sink 104, and a biasing device 106. As described herein, the biasing device is configured to selectively be placed in a first position (or operating position) to bias the lighting device module 102 toward the heat sink 104 and to arrange the driver electronics 108 in an operating positon. The biasing device is also configured to selectively be placed in a second position (or access position) to arrange the driver electronics 108 in an accessible positon and allow or ease access to the driver electronics 108.

In certain examples, as shown in FIGS. 1-6, the lighting device system 100 also includes a housing that may include a base 110 on which the heat sink 104 and the biasing device 106 are attached or supported. In the example in FIGS. 1-6, the base 110 has a generally flat, plate-like shape and has a light outlet opening 110*a* (for alignment with a light outlet opening in 101*a* in the panel 101). In other examples, the base 110 may have other suitable shapes or configurations. The base 110 may be made of any suitable material and, in particular examples, is made of a material having good (relatively high or fast rate) thermal conduction characteristics, such as, but not limited to a heat dissipating metal, plastic, ceramic or composite material, for dissipation of heat from the heat sink 104 mounted on the base 110. In other examples, the base 110 is omitted and the heat sink 104 and the biasing device 106 are attached or supported directly on the panel 101.

In certain examples, the housing includes a cover member 112 that covers the lighting device module 102, the heat sink 104, the biasing device 106 and the driver electronics 108. The cover member 112 may be a box-like structure having an open side (the bottom side in FIGS. 1-6). In other examples, the cover member may have other suitable shapes. The cover member 112 may be made of any suitably rigid material and, in particular examples, the cover member 112 and the base 110 are made of an electrically conductive metal material (or other electrically conductive material) that can be electrically connected to ground (e.g., to a ground conductor present at the installation site), to provide a grounded barrier around the components of the lighting device system 100.

The cover member 112 may be configured to connect (or is connected) to the base 110, or to the panel 101, as shown in FIGS. 1-3. Any suitable attachment mechanism may be used to selectively attach the cover member 112 to the base 110, and also allow selective removal of the cover member 112 from the base plate including, but not limited to one or more threaded fasteners, adhesive, friction fitting, clamps of other fasters, or combinations thereof. In other examples, the cover member 112 may be omitted. In yet other examples, one or both of the heat sink 104 and the biasing device 106 may be attached to and supported on the cover member 112, instead of on the base 110 or the panel 101.

The lighting device system 100 may have additional components, including those described below. In other examples, the lighting device system 100 may include more than one lighting device module 102 and, in yet further examples, may include a corresponding more than one heat sink 104, biasing device 106 and/or driver electronics 108. While FIGS. 1-6 show one example of a lighting device system shape and relative dimensions, other embodiments have other suitable shapes and relative dimensions.

As described herein, the lighting device system 100 is configured to be mounted in or to a ceiling, wall or other structure. In addition, the lighting device module 102 is configured to be selectively installed in and received by (or removed from) the rest of the lighting device system 100, while the lighting device system 100 is in a mounted state in or on the ceiling, wall or other structure. When installed in the lighting device system 100, the lighting device module 102 is abutted against (e.g., in contact or otherwise arranged in thermal communication with) the heat sink 104, such that heat from the lighting device module 102 may be readily communicated to and dissipated by the heat sink 104.

The biasing device 106 is configured to be arranged in a first position (an operation position) to bias or force the lighting device module 102 toward or against the heat sink 104 when the lighting device module 102 is in an installed state, to facilitate holding and maintaining the lighting device module in thermal communication with the heat sink 104. The biasing device 106 is also configured to be selectively moved to a different or second position (an access position), to selectively allow or ease accessibility to the driver electronics 108. The biasing device 106 may be selectively moved between the first position (the operation position) and the second position (the access positon).

In particular examples, the biasing device 106 further includes a moveable support bracket structure that holds the driver electronics 108 and moves the driver electronics 108 from a first position (e.g., an operation positon) to a second position (e.g., an access position), as the biasing device 106 is moved between its first position (operation position) and its second position (access position). In FIG. 5, the biasing device 106 is shown in the first position (operation position), forcing the lighting device module 102 against the heat sink member 104 and positioning the support bracket and the driver electronics 108 in its first position (operation position). In FIG. 6, the biasing device 106 is shown in the second position (the accesses position) and the lighting device module 102 has been removed.

When the biasing device 106 is in the first position (operation position) as shown in FIG. 5, the driver electronics 108 are spaced from the light outlet opening 110*a* in the base 110 (and/or the corresponding opening 101*a* in the panel 101). In that position, the driver electronics 108 are located a sufficient distance from the light outlet opening to provide enough space for the lighting device module 102 to be received and held in alignment with the light outlet opening and adjacent the heat sink member 104.

On the other hand, when the biasing device 106 is in the second position (access position) as shown in FIG. 6, the driver electronics 108 are located closer to or partially within the light outlet opening, to allow a person to reach and selectively remove the driver electronics 108 through the light outlet opening (or to install the driver electronics 108 through the light outlet opening). Therefore, according to particular examples described herein, the biasing device 106 may be configured to hold the lighting device module 102 in thermal contact or communication with the heat sink member 104 while supporting the driver electronics 108 in the operation position (as shown in FIG. 5), and also to be selectively moved to allow or improve access to the driver electronics 108, including moving the driver electronics 108 to the access position (as shown in FIG. 6).

Figure 7:
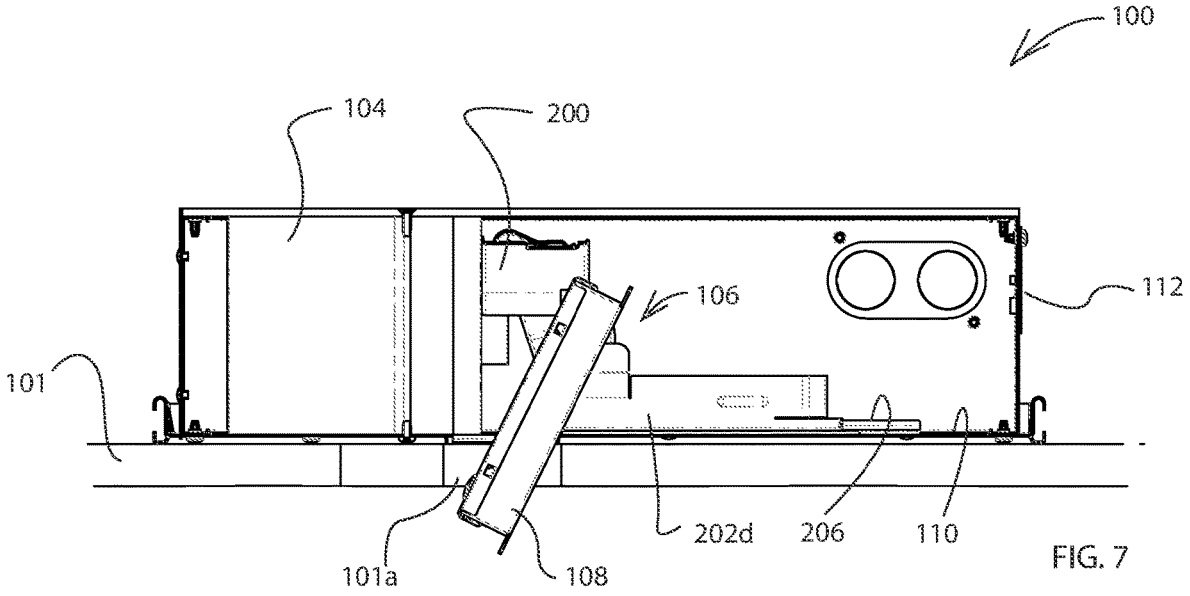
FIGS. 7 and 8 are side, cross-section views of the lighting device system of FIG. 2, as the driver electronics are being installed in or removed from the system.
Figure 8:
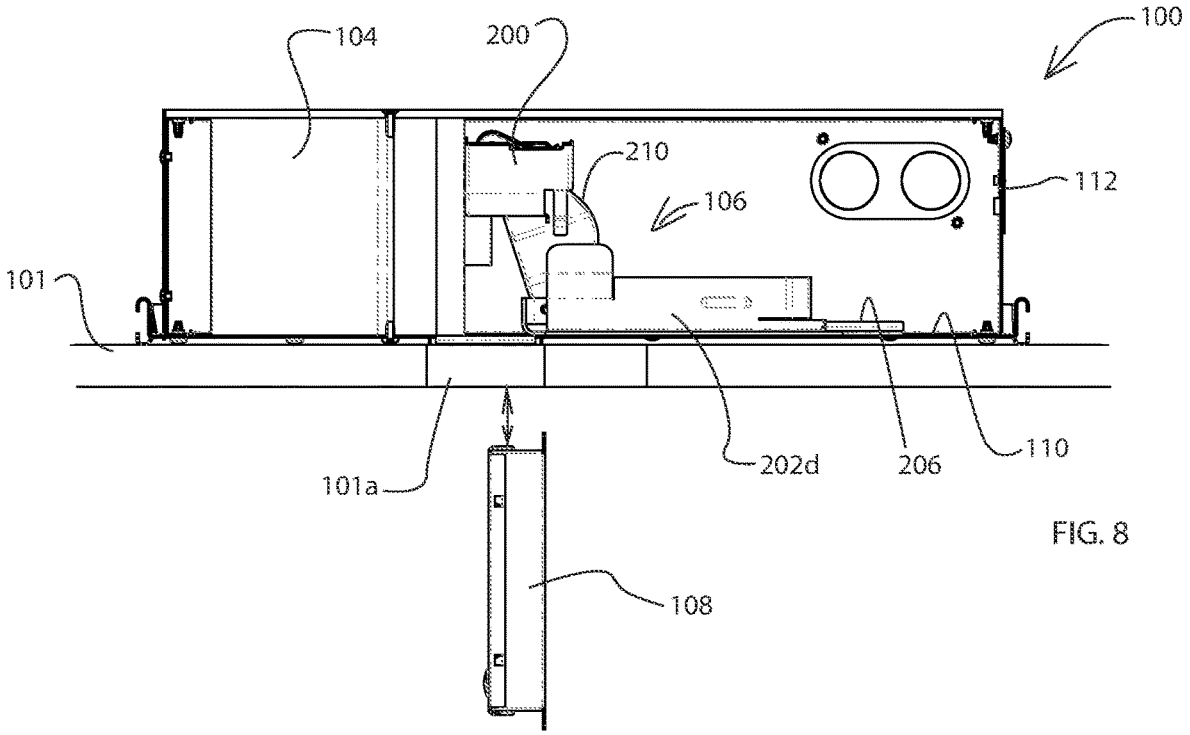
Figure 9:
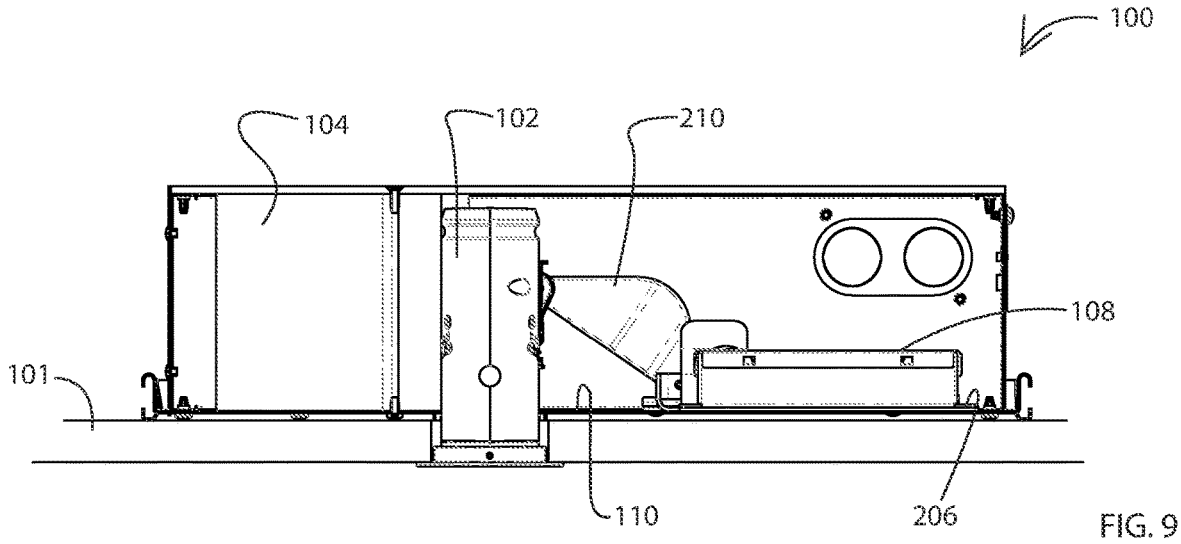
FIGS. 9 and 10 are side, cross-section views of the lighting device system of FIG. 2, as the lighting device module is being installed in or removed from the system.
Figure 10:
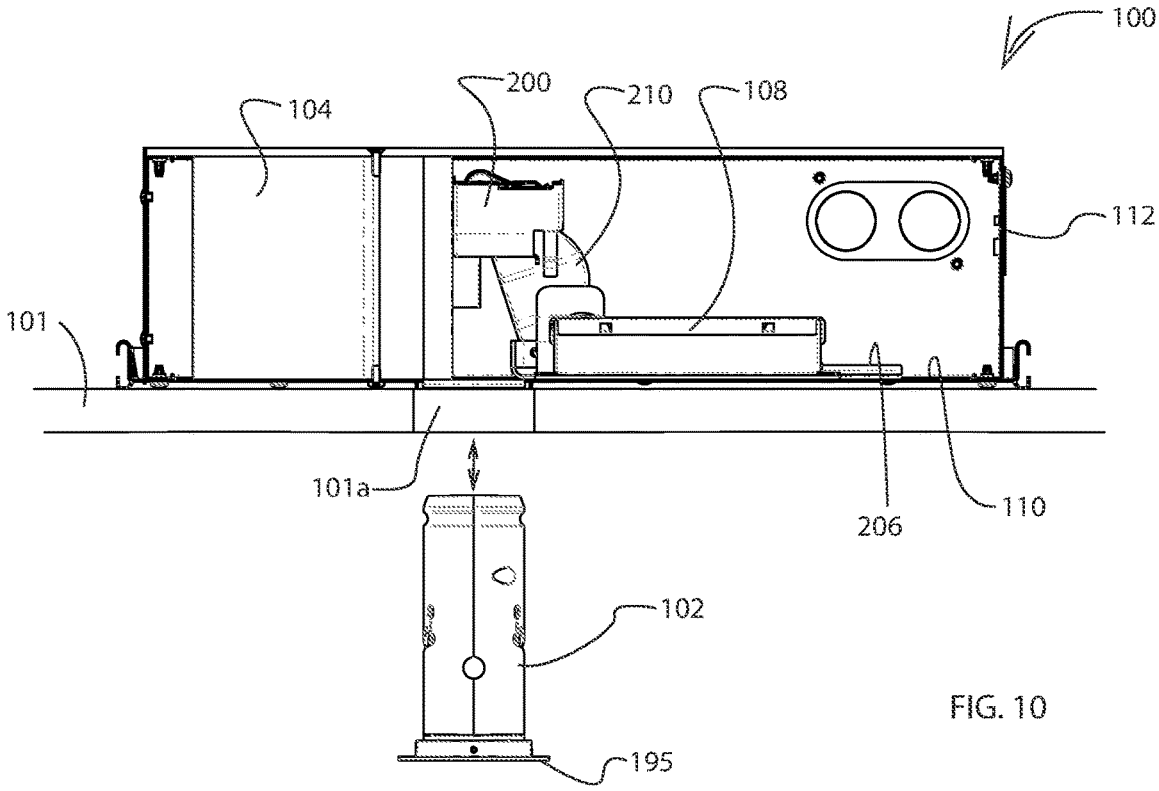

When the biasing device 106 is in its second position (or access position), the driver electronics 108 may be selectively installed in and received by the rest of the lighting device system 100, or be selectively removed from the rest of the lighting device system 100, by passing the driver electronics 108 through the opening 110*a* in the base 110 and (or) through the opening 101*a* in the panel 101 as shown in FIGS. 7 and 8. On the other hand, when the biasing device 106 is in its first position (or operation position), the lighting device module 102 may be selectively installed in and received by the rest of the lighting device system 100, or be selectively removed from the rest of the lighting device system 100, by sliding the lighting device module 102 through the opening 110*a* in the base 110 and (or) through the opening 101*a* in the panel 101 as shown in FIGS. 9 and 10. In the installed state (as shown in FIGS. 5 and 9), the lighting device module 102 is configured to direct light through that same opening 110*a* and (or) 101*a*.

Thus, in particular examples, the lighting device module 102 and the driver electronics 108 to be selectively slid into or out of the lighting device system 100, through a single, relatively small opening 110*a* in the base 110 and (or) opening 101*a* in the panel 101. Such configurations can allow the lighting device system 100 to be concealed behind the panel 101 (e.g., within an inner ceiling space, an inner wall space, a plenum or duct space or an inner space of another object), while a single, relatively small opening is provided for light from the lighting device module 102 to pass. In addition, such configurations can allow the lighting device module 102 or the driver electronics 108 (or both) to be installed in the rest of the lighting device system 100, and to be selectively removed from the rest of the lighting device system 100, through the single, relatively small opening 110*a* in the base 110 and (or) opening 101*a* in the panel 101, for example, to replace, inspect, adjust or service the lighting device module 102 or the driver electronics 108 (or both), as shown in FIGS. 7-10.

Lighting Device Module 102

In particular examples, the lighting device module 102 is configured to provide one or more advantages as described herein, while also providing a good (relatively high or fast rate) of thermal communication for thermal transfer and dissipation of heat from the lighting device module 102 to the heat sink 104, when the lighting device module 102 is installed in the lighting device system 100 (as shown in FIGS. 5 and 9). An example of the lighting device module 102 is shown in perspective and side views, in FIGS. 11 and 12, respectively. FIG. 13 shows an exploded, perspective view of that example lighting device module 102.

Figure 11:
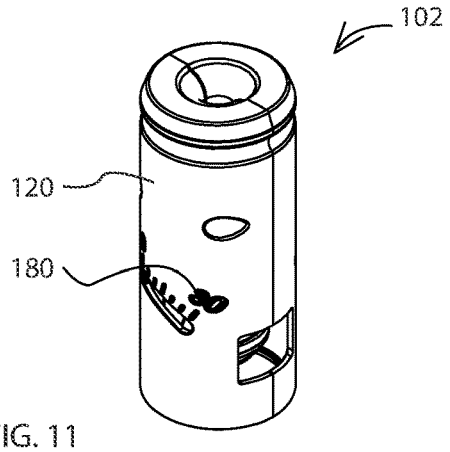
FIG. 11 is a perspective view of a lighting device module for the lighting device system of FIGS. 1-10.
Figure 12:
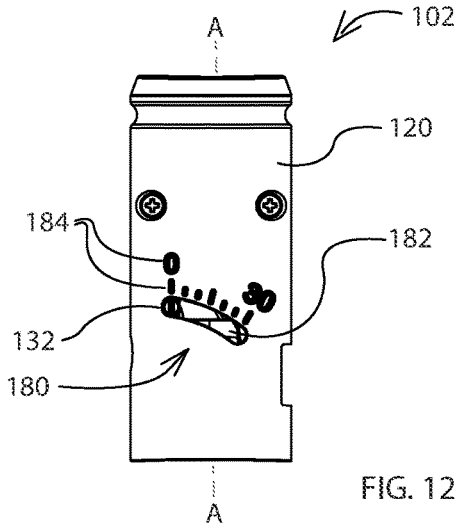
FIG. 12 is a side view of the lighting device module of FIG. 11.
Figure 13:
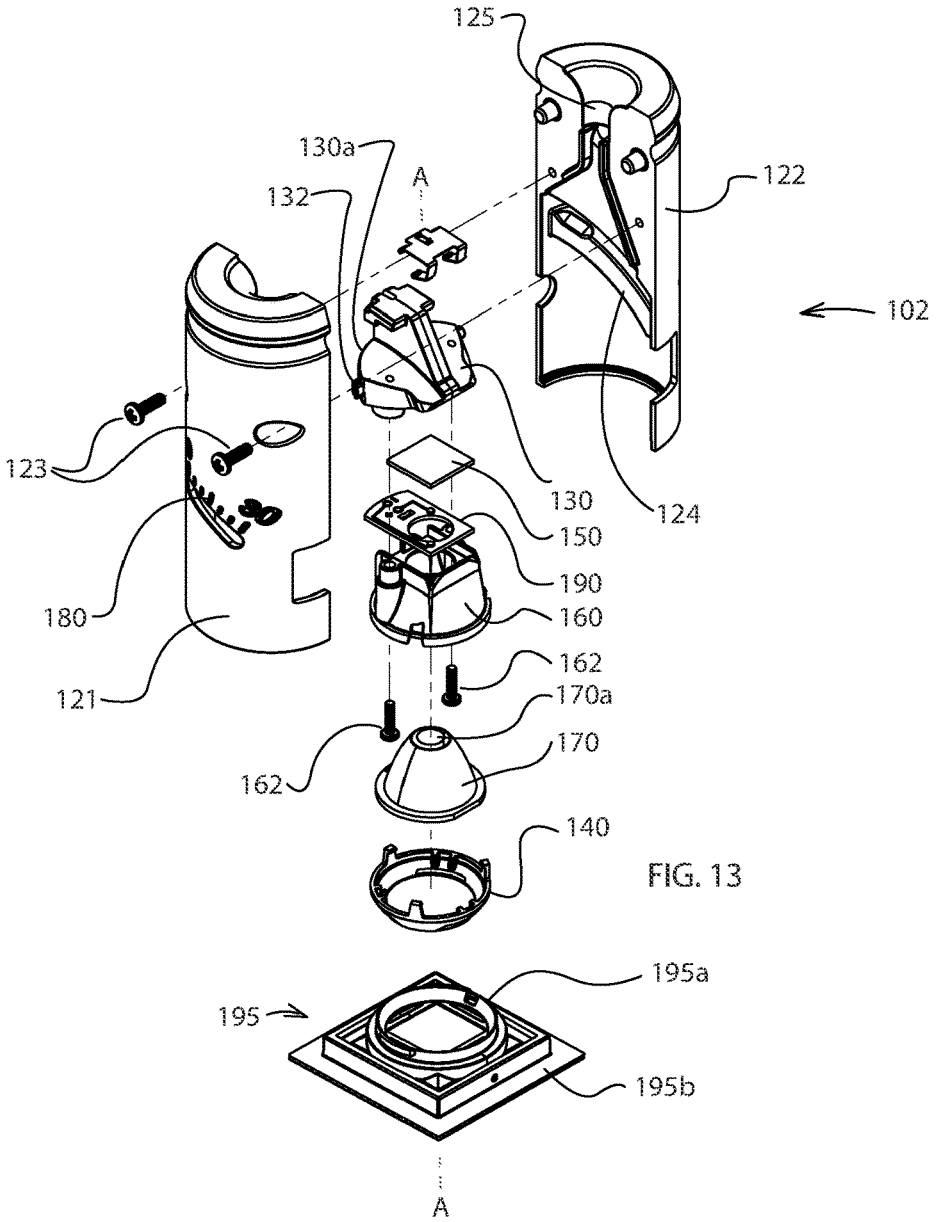
FIG. 13 is an exploded, perspective view of the lighting device module of FIG. 11.

The lighting device module 102 in FIGS. 11-13 includes a module housing 120 with an interior volume that contains and holds other components of the module, including a moveable heat sink member 130, a light source 150, an optic holder 160, and an optic member 170. In certain examples the lighting device module 102, and the components 130, 150, 160 and 170 may correspond to the correspondingly-labeled components of the lighting device module 102 as described in U.S. patent application Ser. No. 17/395,323, filed Aug. 5, 2021, and titled Adjustable Lighting Device Module And System, which is incorporated herein by reference, in its entirety. However, in the example in FIGS. 11-13, the lighting device module 102 further includes at least one angle indicator 180 that indicates an angle of the light source 150 and an angle at which light emitted from the light source is directed. In other examples, the lighting device module 102 may have other suitable configurations.

In some examples, the lighting device module 102 also includes one or more of a retaining ring 140, a light source mounting frame 190, and a trim member 195. In other examples, one or more of the above-described components may be omitted. In the exploded view of FIG. 13, the above-mentioned components (and other components) of the lighting device module 102 are shown as separated along the axis A, and the module housing 120 is further shown as divided on a plane along the axis A.

In the example in FIGS. 11-13 the module housing 120 has a generally cylindrical shape, with a lengthwise dimension along a longitudinal axis A of the cylindrical shape, a round cross-section shape (taken perpendicular to the axis A), and two open ends. One end (the bottom end in FIGS. 11-13) may be open to allow light to pass outward, to allow access to components within the module housing 120 and, in some examples, to receive a connection portion of a trim member 195. A second end (e.g., the top end in FIGS. 11-13) may be open or partially open, or may be closed, in various examples. In certain examples, the second end has an opening through which one or more electrical conductors (not shown) extend, for connecting the light source 150 to the driver electronics 108.

In other examples, the module housing 120 may have other suitable shapes including, but not limited to cylindrical with other cross-section shapes (such as, but not limited to oval, rectangular or other polygonal or combined cross section shape), spheroid, cuboid, or the like. A cylindrical shape can be beneficial as being able to contain components of the lighting device module 102 described herein, yet also fit through a relatively small, round (or oval, rectangular or other polygonal) shaped opening in the panel 101 or the base 110 (or both), for installing or removing the lighting device module 102 to or from the lighting device system 100.

In certain examples (as shown in FIGS. 11-13), the module housing 120 is a two-part housing composed of a first housing side 121 and a second housing side 122 that connect together along an axial plane. The first and second housing sides 121 and 122 may connect together by any suitable connection mechanism including, but not limited to, threaded fasteners 123 (as shown in FIG. 13), adhesives, welding, thermal bonding, tensioning rings or bands, other fasteners or combinations thereof. However, in other examples, the module housing 120 may be made as a single, unitary component, or may be made of more than two parts.

The module housing 120 (including the first and second housing sides 121 and 122) may be made by any suitable manufacturing process or processes including, but not limited to molding, machining, extrusion, or combinations thereof. The module housing 120 (including the first and second housing sides 121 and 122) may be made of any suitably rigid material or materials including, but not limited to metal, plastic, ceramic, composite material, or combinations thereof. In particular examples, the module housing 120 is made of a material having a good (relatively high or fast rate) of thermal dissipation capabilities such as, but not limited to a heat dissipating metal, plastic, ceramic or composite material.

The housing module 120 includes one or more curved or arched rails or tracks (e.g., the rail or track 124 in the housing side 122 and a corresponding rail or track in the housing side 121). The rails or tracks 124 are configured to engage and guide the moveable heat sink member 130 along a curved or arched path of motion, for adjusting a tilt direction of the light source 150 and, thus, the direction of light emission from the light source 150. The rails or tracks 124 are configured to be receive in and interface with channels or grooves 130*a* in each of two opposite-facing sides of the moveable heat sink member 130 to support and hold the heat sink member 130 within the module housing 120, yet allow the heat sink member 130 to be moved along a curved or an arced path, to adjust a tilt direction or angle of the light source 150 (and of a light emitting direction of the light source 150). In other examples, the location of the curved or arched rails 124 and of the channels or grooves may be reversed such that the heat sink member 130 includes the curved or arched rails, while the housing sides 121 and 122 include the matching channels or grooves. In particular examples, the rails or tracks 124 and the manner of engagement with the moveable heat sink member 130 may correspond to those features as described in the above-cited U.S. patent application Ser. No. 17/395,323. In other examples, the light source 150 may be mounted for adjustment of a tilt direction (and, thus, the direction of light emission) of the light source 150 by other suitable mounting structure.

The moveable heat sink member 130 includes a heat sink body that has a shape and configuration to fit within the interior volume of the module housing 120, when the housing sides 121 and 122 are connected together. The body of the moveable heat sink member 130 may be made of a material having good (relatively high or fast rate) thermal dissipating capabilities such as, but not limited to a heat dissipating metal, plastic, ceramic or composite material, or combinations thereof.

The body of the moveable heat sink member 130 has a mounting surface (the downward-facing surface in FIG. 13) on which the light source 150 is secured. The light source 150 is secured to the surface of the moveable heat sink member 130 by the frame 190 (or other suitable fastener or securing mechanism) and is oriented to emit light in a direction toward the optic member 170. In particular examples, the body of the moveable heat sink member 130 includes one or more channels or grooves (not shown) through which one or more electrically conductive wires or other electrical conductors (not shown) may extend and electrically connect the light source 150 to the driver electronics 108.

The light source 150 may include any suitable light emitting device or devices. In particular examples, the light source 150 includes one or more LEDs or other light source that generates heat during operation. In such examples, the one or more LEDs (or other light source) may be mounted on a circuit board or other support structure. In particular examples, the light source 150 is fixed to and mounted in thermal communication with the mounting surface of the moveable heat sink member 130, such that the heat sink member 130 may efficiently receive and conduct heat from the light source 150. The moveable heat sink member 130 may be configured to conduct and dissipate heat away from the light source 150, which can significantly improve the efficiency and light output of the one or more LEDs (or other heat-generating light sources). While particular examples described herein include a light source 150 having one or more LEDs, other examples may include other suitable light sources such as, but not limited to one or more halogen, halide, fluorescent, or incandescent light sources, or other electrical discharge or electroluminescence device, or the like.

The optic holder 160 is configured to hold and retain the optic member 170 and to connect and be fixed to the moveable heat sink member 130 (or to the frame 190). The optic holder 160 may be made of any suitable rigid material or materials including, but not limited to plastic, metal, ceramic, composite material, or combinations thereof. The optic holder 160 may be made by any suitable manufacturing process including, but not limited to molding, machining, extrusion, or combinations thereof. The optic holder 160 may be secured to the moveable heat sink member 130 (or to the frame) by any suitable connection mechanism including, but not limited to, threaded fasteners 162 (as shown in FIG. 13), adhesives, welding, thermal bonding, other fasteners or combinations thereof.

The optic member 170 may be a lens, filter, or other optical device that passes light, and affects a characteristic of the light being passed. In certain examples, the optic member 170 includes a lens configured to focus light toward one or more focus points or centers of focus. In some examples, the optic member 170 may have a configuration for directing light through a relatively small aperture or opening (e.g., the opening 101*a*, the opening 110*a*, and/or an opening in the trim member 195). Some examples of such optic members that may be employed for optic member 170 are described in the Applicant's U.S. Pat. No. 10,900,654 (which is incorporated herein by reference, in its entirety). In other examples, the optic member 170 may include other suitable lens configurations.

In particular examples, the optic member 170 has a light-receiving side 170*a* that faces the light source 150 and is configured to receive (and receives) light generated from the light source 150. The optic member 170 also has a light-emitting side (the downward-facing end in FIG. 13) that faces the open end of the module housing 120, and is configured to emit light passing through the optic member 170.

When assembled as shown in FIGS. 11 and 12, the optic member 170, the optic holder 160, the frame 190 and the light source 150 are connected in a fixed relation to each other and with the body of the moveable heat sink member 130. In certain examples, the retaining ring 140 secures the optic 170 to the optic holder 160, for example, by friction fit, snap fit, adhesive material or other suitable fasteners or attachment mechanism for attaching the retaining ring 140 to the optic holder 160. Accordingly, as the body of heat sink member 130 moves along the tracks or rails 124, those components move with the heat sink member 130 along a curved or ached path defined by the curved or arched rails or tracks 124. In that manner, the light source 150 is moved along a curved or arched path with movement of the body of the heat sink member 130, to change or adjust the angle of the light source 150 (and the direction of light emitted from the light source) relative to the axis A. In particular examples, the angle of the light source 150 may be adjusted, manually or with a tool, by inserting a hand, one or more fingers or a tool through an open end of the housing 120 (i.e., the bottom end in FIGS. 11-13) and applying a force on the optic 170 or to the optic holder 160, to move the heat sink member 130 along the curved or arched rails 124.

As the heat sink member 130 is moved along the curved or arched rails 124, the angle indicator 180 provides a visual indication of the angle of light source (and the angle of light emitted from the light source) relative to the axis A. In the example in FIGS. 11-13, the angle indicator 180 includes a curved or arched slot-shaped opening 182 in at least one of the housing sides 121 or 122 (or a separate slot-shaped opening in each of the housing sides 121 and 122). The (or each) slot-shaped opening 182 is open to the interior of the module housing 120 and has a curve or arch that matches the curve or arch of the rails 124. In addition, the (or each) slot-shaped opening 182 extends along (and is located adjacent) the positions of the heat sink member 130, throughout the movement of the heat sink member 130 along the curved or arched rails 124.

Accordingly, at least a portion of the heat sink member 130 is visible through the slot-shaped opening 182, as the heat sink member 130 is moved along the curved or arched rails 124, and at each position of the heat sink member 130 along that curved or arched rails. In particular examples, one or more portions of the heat sink member 130 may include a feature 132 of enhanced visibility, that can be visually seen through the slot shaped opening 182. In certain examples, the feature 132 includes one or more of a protrusion, a recess, a visible marking, a colored section of different color than other sections of the heat sink member 130, or the like.

In the example in FIGS. 11-13, the angle indicator 180 also includes indicia 184 provided along the curved or arched slot-shaped opening 182. The indicia 184 may identify a plurality of different angles (or a range of angles) at (or along) which the light source 150 (and light from the light source) may be directed, based on the position of the feature(s) 132 visible through the slot shaped opening 182. The indicia 184 may be printed, impressed, molded or otherwise provided on one or each of the housing sides 121 and 122.

In the example in FIGS. 11-13, the indicia includes multiple markings showing a range of angles between 0 degrees and 30 degrees. In other examples, other suitable markings and other suitable angle ranges may be employed. Accordingly, as the heat sink member 130 is moved along the rails 124 (and at each position of the heat sink member 130 along its movement), the feature(s) 132 may be visible through the slot shaped opening(s) 182, in alignment with the indicia 184, to indicate the angle of the light source 150 (or the direction of light emitted from the light source 150) relative to the axis A. In FIG. 12, the visible feature 132 is in alignment with the 0 degrees marking on the indicia 184, indicating that the light source 150 is arranged (and the direction of light emitted from the light source 150 is directed) at 0 degrees relative to the axis A (or, along the axis A).

In particular examples, the rails or tracks 124 are configured to engage and contact the heat sink member 130, and to remain engaged and in contact throughout the range of motion of the heat sink member 130 relative to the module housing 120. In certain examples, those features engage in sufficient thermal contact to provide a good (relatively high or fast rate of) thermal communication for the transfer of heat from the heat sink member 130 to the housing sides 121 and 122, for dissipation as described herein. In particular, heat generated by the light source 150 may be transferred to the moveable heat sink member 130, and from the heat sink 130 to the housing sides 121 and 122, for dissipation. In addition, as described herein, the housing 120 of the lighting device module 102 may be held in good (relatively high or fast rate of) thermal communication with the heat sink 104, for the transfer of heat from the housing 120 to the heat sink 104, when the lighting device module 102 is installed.

Accordingly, thermal energy may be conducted away, relatively quickly, from the light source 150 of the lighting device module 102, while also allowing the angle of the heat sink member 130 (with the light source 150) to be moveably adjustable within the module housing 120, relative to the axis A. In addition, the angle indicator 180 may be readily viewed to identify the angle of light source (and the angle of light emitted from the light source) relative to the axis A during or after adjustment.

In certain examples, the assembled lighting device module 102 may be electrically connected to the driver electronics 108, via the electrical conductors (not shown). After connecting the lighting device module 102 to the driver electronics 108, the assembled lighting (and angle-adjusted) device module 102 may be inserted through an opening 101*a* in a panel 101 and/or the opening 110*a* in the base 110 (as shown in FIG. 10), to install the lighting device module 102 the lighting device system 100 (e.g., mounted in a ceiling, wall or other structure).

Biasing Device 106

The biasing device 106 includes a biasing member 200 that is configured to be arranged in a first position (an operation position as shown in FIGS. 5 and 9) to bias or force the lighting device module 102 toward or against the heat sink member 104 when the lighting device module 102 is installed. From that first position, the biasing device 106 is configured to be selectively moved to a second position (an access position as shown in FIGS. 6 and 10), to selectively allow or ease access to the driver electronics 108.

The biasing device 106 further includes a support bracket structure 202 that holds the driver electronics 108 and moves the driver electronics 108 from a first position (e.g., an operation positon) to a second position (e.g., an access position), as the biasing device 106 is moved between its first position (operation position) and its second position (access position). The support bracket structure 202 includes a receptacle in or on which the driver electronics 108 may be supported and held. The support bracket structure 202 also includes flange portions 202*a* and 202*b* that extend outward from two opposite-facing sides of the receptacle.

In the example in FIGS. 4-10, the support bracket structure 202 includes two, spaced-apart side members 202*c* and 202*d* and a base member 202*e*. The side members 202*c* and 202*d* may be formed integral with, or may be attached to the base member 202*e* by any suitable attachment mechanism including, but not limited to threaded fasteners, adhesives, welding, thermal bonding, clamps or other fasteners, or combinations thereof. The receptacle for the driver electronics 108 includes a volume space located between the two side members 202*c* and 202*d*, and above a base member 202*e*. The side members 202*c* and 202*d* and the base member 202*e* may be made of any suitably rigid material, such as, but not limited to metal, plastic, ceramic, composite material, or combinations thereof.

In the example in FIGS. 4-10, the base member 202*e* has a plate-like shape, and the side members 202*c* and 202*d* are attached to or formed on the base member 202*e* at locations spaced from two side peripheral edges of the base member 202*e*. A side portion of the base member 202*e* extends laterally outward from below each of the side members 202*c* and 202*d*, to form the flange portions 202*a* and 202*b*, respectively.

The flange portions 202*a* and 202*b* of the support bracket structure 202 are configured to interface with first and second rails 204 and 206 mounted on the base 110. (In examples in which the base 110 is omitted, the first and second rails 204 and 206 may be mounted directly on the panel 101.) In particular examples, the rails 204 and 206 are configured to engage and retain the base member 202*e* and also allow sliding motion of the base member 202*e* relative to the base 110 (or the panel 101).

Each rail 204 and 206 is attached to the base 110 (or the panel 101) by any suitable attachment mechanism including, but not limited to threaded fasteners, adhesives, welding, thermal bonding, clamps or other fasteners, or combinations thereof. In other examples, one or both of the rails 204 and 206 may be formed as a single, unitary structure with the base 110. In the example in FIGS. 4-10, the rails 204 and 206 extend partially over the flange portions 202*a* and 202*b* of the support bracket structure 202, to retain the support bracket structure 202 to the base 110 (or the panel 101) and also allow sliding movement of the support bracket structure relative to the rails 204 and 206 (and the base 110 or the panel 101), in directions toward or away from the opening 110*a* (or the opening 101*a*). In that example, the support bracket structure 202 is movable by sliding along the rails 204 and 206 between the first position (the operation position) shown in FIGS. 5 and 9, and a second position (the access position) shown in FIGS. 6 and 10. Other examples may include other suitable structure for retaining the support bracket structure 202 on the base 110 (or on the panel 101) while allowing motion relative to the base 110 (or the panel 101) toward and away from the opening 110*a* (or 101*a*) including, but not limited to other slidable structures, rollers, or the like.

The support bracket structure 202 is connected to the biasing member 200, through a pair of arm members 208 and 210. Each arm member 208 and 210 is pivotally attached to the support bracket structure 202 at a first pivot joint 212, and is pivotally attached to the biasing member 200 at a second pivot joint 214 (shown in view on the arm member 208 in FIG. 4, and similarly included on the arm member 210).

The biasing member 200 includes a surface 200*a* for engaging the lighting device module 102, when the lighting device module 102 is installed in the rest of the lighting device system 100 and the biasing device 106 is in the first position (or operation position). In the example in FIGS. 4-10, the surface 200*a* is a curved or arched surface that is configured to receive and engage the curved peripheral side of the generally cylindrical lighting device module 102. In other examples, the surface 200*a* may have other suitable shapes for matching or engaging a side surface of the lighting device module 102. When engaged with the lighting device module 102, the surface 200*a* of the biasing member 200 forces the lighting device module 102 toward or against a surface 104*a* of the heat sink member 104.

In the example in FIGS. 4-10, the curved or arched surface 104*a* is configured to envelop at least a portion of the curved peripheral side of the generally cylindrical lighting device module 102, to enhance thermal communication between the housing 120 of the lighting device module 102 and the surface 104*a* of the heat sink member 104, when the lighting device module 102 is forced towards or against the surface 104*a*. In other examples, the surface 104*a* may have other suitable shapes for providing or enhancing thermal communication with the lighting device module 102.

The biasing member 200 also includes side flanges 200*b* and 200*c*. Each side flange 200*b* and 200*c* is pivotally connected to the heat sink member 104 (or to structure fixed to the heat sink member 104) through a third pivot joint 216. The third pivot joint 216 is spaced from the second pivot joint 214 and allows the biasing member 200 to rotate upward about the axis of the third pivot joint 216, as the biasing device 106 is moved from its first position (or operation position) as shown in FIGS. 4, 5 and 9, to its second position (or access position) as shown in FIGS. 6 and 10.

Each of the pivot joints 212, 214 and 216 associated with each arm member 208 and 210 may be formed of any suitable pivotal joint structure including, but not limited to a pivot pin or axle extending from or through an arm member 208 or 210, and either extending from or through the side flange 200*b* or 200*c*, or the side member 202*c* or 202*d*. The axis of each pivot joint 212, 214 and 216 may be approximately parallel to the surface of the base 210 (or of the panel 101) on which the biasing device 106 is mounted.

Heat Sink Member 104

The heat sink member 104 includes a heat sink body be made of a material having good (relatively high or fast rate) thermal dissipating capabilities such as, but not limited to a heat dissipating metal, plastic, ceramic or composite material, or combinations thereof. In certain examples, the heat sink member 104 is composed of a single, unitary body of such material, for improved heat dissipating capabilities. In particular examples, the body of the heat sink member 104 is made of a generally solid, unitary piece of material that is configured as described herein. In some examples, as illustrated, the body of the heat sink member 104 may include one or more (or a plurality of) fins or other shaped features to help dissipate heat from the body of the heat sink member 104.

The body of the heat sink member 104 has a mounting surface (the bottom surface in FIG. 4) that is supported on a surface of the base plate 110 or on a surface of the panel 101 (i.e., the upward-facing surfaces in FIG. 4). In particular examples, the mounting surface of the heat sink member is generally flat or otherwise configured to abut against a flat surface of the base plate 110 or the panel 101. The heat sink member 104 may be secured to the base plate 110 or the panel 101 by any suitable connection mechanism such as, but not limited to adhesives, welding, friction fitting, clamps or other fasteners.

As described herein, the contact surface 104*a* of the heat sink member 104 is arranged to abut and contact a portion of the outer surface of the module housing 120, when the lighting device module 102 is installed in the lighting device system 101. In particular examples the contact surface 104*a* extends transverse (such as, but not limited to perpendicular to) the mounting surface of the heat sink member 104, and is arranged to abut along a side portion of the module housing 120.

In the example, the contact surface 104*a* is a curved surface defining a partial cylindrical recess along one side of the heat sink member 104. In particular examples, the curvature of the contact surface 104*a* has a radius or other shape that is the same (or about the same) as the radius of curvature or shape of the outer surface of the module housing 120, such that the module housing 120 fits partially within the recess of the curved contact surface 104*a*, and abuts, flush, with the contact surface 104*a*, when the lighting device module 102 is installed in the lighting device system 101. In certain examples, the module housing 120 is configured to abut the contact surface 104*a* along the entire (or substantially the entire) axial length dimension of the module housing 120.

The module housing 120 is configured to abut and contact the contact surface 104*a* of the heat sink member 104 to transfer heat from the module housing 120 to the heat sink member 104. The amount of surface area of the module housing 120 in contact with the contact surface 104*a* of the heat sink member 104 (and, thus, the heat transfer capability) is increased by one or both of the curvature of the contact surface 104*a* extending around a portion of the module housing 120, or the axial length of the contact surface 104*a* extending along the entire (or substantially the entire) axial length of the module housing 120.

Driver Electronics 108

In certain examples, the driver electronics 108 may be contained in a single module or housing, as shown in FIGS. 7 and 8. In other examples, the driver electronics 108 may be configured in multiple components. The driver electronics 108 electrically connect with the light source 150 in the lighting device module 102, through one or more electrical conductors (not shown). The driver electronics 108 also electrically connect with a source of electrical power through further conductors (not shown), which may extend through openings 112*a* in the cover member 112. Those further conductors may connect to an AC power line or other power source that is provided in the ceiling, the wall or the other structure in which the lighting device system 100 is installed.

The driver electronics 108 are configured to convert power provided through those further conductors from the power source, to a suitable power for driving the light source 150. In some examples, the driver electronics 108 (or other electronics within the lighting device system 100) may include a processor to execute instructions stored on memory (e.g., non-transient computer readable media) or transmitted to the processor, to process data and/or to control various functions of the lighting device (such as, but not limited to, temperature, light output, color of light, direction of light, focus of light, and/or the like). In particular examples, the light source 150 includes an LED, and the driver electronics 108 includes one or more LED drivers to drive the LED light source 150.

Trim Member 195

Certain examples described herein may include a trim member 195. In other examples, the trim member may be omitted. The trim member 195 may include a first portion 195*a* for connection to the housing 120 of the lighting device module 102, and a second portion 195*b* that forms a flange or lip around and adjacent the light outlet opening of the lighting device module 102. When the lighting device module 102 is installed in the system 100, the flange or lip portion 195*b* of the trim member 195 may be located on an exposed side of the panel 101 (or of the base 110).

The trim member 195 may be configured to provide one or more functions including, but not limited to aesthetic or ornamental functions, heat dissipation functions, reduction of the size of the light outlet opening of the lighting device module 102, or combinations thereof. In particular examples, the flange or lip portion 195*b* is configured to be located on the exposed side of the panel 101 (or of the base 110) and may be configured to cover (and hide from view) a space or gap at the outer circumference of the opening 101*a* in the panel 101 (or the opening 110*a* in the base 110) that might otherwise be visible from the exposed side of the panel 101 (or of the base 110). Additionally or alternatively, the flange or lip portion 195*b* may be configured with an ornamental or aesthetic design that provides aesthetic contrast to the exposed surface of the panel 101 (or of the base 110), or may be configured with an appearance that corresponds to and matches the appearance of the exposed surface of the panel 101 (or of the base 110) to be visually obscure.

The trim member 195 has a generally annular shape, with a central opening through which light emitted from the light source 150 may pass. In some examples, a lens or other light affecting material may be secured to the trim member 195, over the central opening. In some examples, the shape of the flange or lip portion 195*b* of the trim member 195 may have a shape and a size corresponding to the shape and size of the opening 101*a* in the panel 101 (or the opening 110*a* in the base 110). In the example in FIGS. 1-13, the flange or lip portion 195*b* of the trim member 195 (and the openings 101*a* and 110*a* in the panel 101 and the base 110, respectively) have a generally rectangular shape. In other examples, the flange or lip portion 195*b* of the trim member 195 (and the openings 101*a* and 110*a*) may have other suitable shapes including, but not limited to round, oval, polygonal or combinations thereof.

The trim member 195 is configured to connect to the housing 120 of the lighting device module 102, in alignment with the light outlet opening of the housing 120. Any suitable connection mechanism to connect the first portion 195*a* of the trim member 195 to the housing 120 such as, but not limited to threaded fasteners, adhesives, welding, friction fitting, clamps or other fasteners, or combinations thereof. In some examples, the lighting device system 100 may include a connection mechanism to connect the trim member 195 to the panel 101 or to the base 110, such as, but not limited to threaded fasteners, adhesives, welding, friction fitting, clamps or other fasteners or combinations thereof.

When installed, the trim member 195 (or the flange or lip 195*b* of the trim member 195) may fit flush with or abutted against the exposed surface (the downward-facing surface in FIGS. 1, 2, 9 and 10) of the panel 101 or the base 110. In certain examples, the flange or lip 195*b* of the trim member 195 may include a plurality of openings for receiving a plaster, joint compound, spackling, drywall mud, gypsum-based paste, putty, or the like (plaster material), such as, but not limited to the configuration described with regard to the third heat sink member 106 in U.S. Pat. No. 10,900,654 titled "Small Aperture Lighting Device," which is incorporated herein in its entirety.

The trim member 195 (including the flange or lip 195*b* of the trim member 195) is made of any suitably rigid material, such as, but not limited to metal, plastic, ceramic, composite material, or combinations. In particular examples, the trim member 195 is made of a material having good (relatively high or fast rate) thermal dissipating capabilities such as, but not limited to a heat dissipating metal, plastic, ceramic or composite material, or combinations thereof. In those examples, the trim member 195 may be configured to connect to the housing 120 of the lighting device module 102 in good thermal contact or communication with the housing 120, to transfer heat from the lighting device module 102, to the trim member 195. As the flange or lip 195*b* of the trim member 195 is configured to be located on the exposed side of the panel 101 or of the base 110, the flange or lip 195*b* may be configured to dissipate heat into the environment adjacent (below) the panel 101 or the base 110, to facilitate dissipation of heat from the light source 150.

Installation and Removal

In particular examples, the biasing device 106 and the heat sink member 104 are installed on a surface of the panel 101, for example during or after construction of a ceiling, wall or other structure. In some examples, those components may be mounted on the base plate 110 (which may be mounted to the surface of the panel 101) and, in any of those examples, the cover member 112 may be mounted over those components. The heat sink member 104 may be mounted and supported adjacent the opening 101*a* in the panel 101.

In addition, the biasing device 106 may be arranged in the second position (the access position as shown in FIGS. 6-8 and 10), to provide access to the mounting bracket 109 in (or from) which the driver electronics 108 may be received (or removed). When the biasing device 106 is in the second position (the access position), the mounting bracket 109 is located closer to the opening 101*a* in the panel 101 and the opening 110*a* in the base 110, relative to the first position (the operation position) of the biasing device 106. In addition, when the biasing device 106 is in the second position (the access position), the biasing member 200 of the biasing device 106 is moved away from a location between the mounting bracket 109 and the opening 110*a* (or the opening 101*a*) and, thus, does not block access to the mounting bracket 109 from those openings.

Accordingly, in that second position, the driver electronics 108 may be readily installed into the lighting device system 100, by passing the driver electronics 108 through the opening 101*a* in the panel 101 and the opening 110*a* in the base 110, and into the mounting bracket 109 (as shown in FIGS. 7 and 8). Either before or after the driver electronics 108 is passed through the openings 101*a* and 110*a*, the driver electronics 108 may be electrically connected to the lighting device module 102 through one or more electrical conductors (not shown) extending from the driver electronics 108, or from the lighting device module 102, or from both.

Once the driver electronics 108 are placed in the mounting bracket 109, the biasing device 106 may be moved to its first position (or operation position). In particular examples, a person may insert a hand, fingers or a tool through the openings 101*a* and 110*a* to contact the mounting bracket 109 and apply a force to push the mounting bracket 109 from the second position (access position) to the first position (operation position). As the mounting bracket 109 is moved to the first position (operation position), the arm members 208 and 210 cause the biasing member 200 to rotate downward about the axis of the third pivot joint 216 to its first position (operation position) as shown in FIG. 4.

When the biasing member 200 is in that first position (operation position), the lighting device module 102 may be inserted through the openings 101*a* and 110*a*, into the volume space between the contact surface 104*a* of the heat sink member 104 and the biasing member 200. More specifically, the lighting device module 102 may be inserted and installed into the lighting device system 100, by passing the lighting device module 102 through the same openings 101*a* and 110*a*, and into a volume space adjacent the contact surface 104*a* of the heat sink member 104 (between the contact surface 104*a* of the heat sink member 104 and the biasing member 200). When installed, the light outlet opening (the bottom-facing opening in FIG. 10) of the lighting device module 102 is aligned with the openings 101*a* and 110*a* to emit light out through the openings 101*a* and 110*a*.

In particular examples, that volume space between the contact surface 104*a* of the heat sink member 104 and the biasing member 200 has a width that is about the same width as the diameter (or width) of the lighting device module 102 such that the lighting device module 102 is fitted into that volume space by friction fit. The width of the volume space is sufficiently dimensioned, to cause the biasing member 200 to force the housing 120 of the lighting device module 102 against the contact surface 104*a* of the heat sink member 104, and maintain or enhance thermal communication between those components, when the biasing member 200 is in the first position (operation position) as shown in FIG. 9. In particular example, friction fit or force applied by the biasing member 200 is sufficient to retain the lighting device module 102 in the light device system (and to hold the lighting device module 102 against the force of gravity). In other examples, other suitable fasteners, adhesives or combinations thereof, may be included on or with the lighting device module 102, to secure the lighting device module 102 to the rest of the lighting device system 100.

When the lighting device module 102 is secured in the lighting device system 100 as shown in FIG. 9 and is connected to the driver electronics 108, the lighting device module 102 may be energized to generate and direct light out through the aligned openings 101*a* and 110*a* in the panel 101 and the base plate 110 and through the trim member 195. Adjustment (or further adjustment) of the tilt angle of the light emitted by the lighting device module 102 may be carried out by, for example, temporarily withdrawing the lighting device module 102 from the rest of the lighting device system (e.g., as discussed below), adjusting the tilt angle of the light source 150 as described above, and re-installing the lighting device module 102 (e.g., as discussed above). The angle indicator 180 may be observed during or after adjusting the tilt angle. In other examples, the tilt angle may be adjusted, while the lighting device module 102 is in an installed state.

From an installed state, the lighting device module 102 and the driver electronics 108 may be selectively removed and withdrawn from the lighting device system 100, for example, for inspection, adjustment, replacement, repair, or another purpose. Removal of the lighting device module 102 may be accomplished by withdrawing the lighting device module 102 out of the openings 101*a* and 110*a*, for example, by applying a force in the downward direction of FIG. 10, manually or with a tool. In particular, a force is applied, sufficient to overcome the frictional engagement of the lighting device module 102 with the contact surface 104*a* of the heat sink member and the biasing member 200, to cause the lighting device module 102 to slide out from the rest of the lighting device system, through the openings 101*a* and 110*a*.

Once the lighting device module 102 is withdrawn from the openings 101*a* and 110*a*, the biasing device 106 may be moved from its second position (operation position) to its first position (access position). In particular examples, a person may insert a hand, fingers, or a tool through the openings 101*a* and 110*a*, to engage and apply a force onto the biasing member 200 or to engage and apply a force onto the mounting bracket 109. For example, a force may be applied to the biasing member 200, directed to pivot the biasing member 200 upward about the axis of the third pivot joint 216. In doing so, the arm members 208 and 210 transfer the pivotal motion to linear motion of the mounting bracket 109 along the length dimensions of the rails 204 and 206, to move the mounting bracket 109 to its second position (access position) as shown in FIG. 10. Alternatively, the force may be applied to the mounting bracket 109, directed to move the mounting bracket 109 away from the openings 101*a* and 110*a*, along the length dimension of the rails 204 and 206. By thus moving the mounting bracket 109 away from the openings 101*a* and 110*a*, the arm members 208 and 210 pivot the biasing member 200 upward and away from a position between the mounting bracket 109 and the openings 101*a* and 110*a*, as shown in FIG. 10.

When the biasing member 200 is pivoted upward and the mounting bracket 109 is in its second position (access position) as shown in FIG. 10, a person may readily reach the mounting bracket 109 (and the driver electronics 108 in the mounting bracket 109) through the openings 101*a* and 110*a*, for removal of the driver electronics 108 from the lighting device system (as shown in FIGS. 7 and 8). In certain examples, the driver electronics 108 may be electrically disconnected from the lighting device module 102, either after removal of both of those components from the rest of the lighting device system 100, or after removal of the lighting device module 102 and before removal of the driver electronics 108 from the rest of the lighting device system 100.

After removal of one or both the lighting device module 102 and the driver electronics 108, those components may be inspected, adjusted, repaired and replaced, or replaced with another lighting device module 102 and (or) another driver electronics 108, by employing the methods described above for installing the lighting device module 102 and the driver electronics 108. Accordingly, examples of the lighting device system 100 may allow ease of access to the lighting device module 102 and the driver electronics, while other components of the lighting device system, including the heat sink member 104, the biasing device 106, the base 110 and the cover 112 may remain in their installed state, for example, within an attic or ceiling space, an inner wall space, a plenum or duct space or the like. In addition, the lighting device system 100 can provide or enhance thermal communication between the lighting device module 102 and the heat sink member 104, when the lighting device module 102 is installed.

In various examples described herein, certain components are described as having a cylindrical shape, rectangular shapes, round shapes or other shape including, but not limited to the module housing 102, and the trim member 195. However, in other examples, those components may have other suitable shapes including, but not limited to shapes having polygonal or other circular or non-circular cross-sections or combinations thereof. In some examples, those components may have an outer shape configured to provide an aesthetically pleasing, artistic, industrial or other impression.

The foregoing description of illustrative embodiments has been presented for purposes of illustration and of description. It is not intended to be exhaustive or limiting, and modifications and variations may be possible in light of the above teachings or may be acquired from practice of the disclosed embodiments. Various modifications and changes that come within the meaning and range of equivalency of the claims are intended to be within the scope of the invention. Thus, while certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed is:

1. A lighting device system comprising:

at least one lighting device module having a module housing configured to be selectively inserted into an installed state, at least partially through an opening in a panel or a base;

driver electronics configured to be electrically coupled to the at least one lighting device module to provide electrical power to the at least one lighting device module;

at least one heat sink member having a contact surface, the at least one heat sink member being located adjacent the opening in the panel or the base; and at least one movable biasing device having a first position to apply a bias force on the at least one module housing, the bias force pressing the at least one module housing toward the contact surface of the at least one heat sink member to increase thermal transfer between the at least one module housing and the contact surface when the at least one module housing is inserted in the installed state, the at least one biasing device having a second position to provide improved access to the driver electronics through the opening in the panel or base relative to the first position;

wherein the at least one movable biasing device is selectively moveable from the first position to the second position, or from the second position to the first position.

2. The lighting device system of claim 1, wherein:

the at least one movable biasing device comprises a moveable biasing member configured to apply the bias force, and a mounting bracket for holding the driver electronics;

the biasing member is arranged between the opening and the mounting bracket when the at least one movable biasing device is in the first position, and the biasing member is arranged in a location that is not between the opening and the mounting bracket when the at least one movable biasing device is in the second position.

3. The lighting device system of claim 2, further comprising at least one arm, each arm being pivotally connected to the mounting bracket at a first pivot joint, and pivotally connected to the biasing member at a second pivot joint that is separated from the first pivot joint by a length portion of the arm.

4. The lighting device system of claim 3, wherein the biasing member is pivotally connected to the at least one heat sink member at a third pivot joint that is separated from the first pivot joint and from the second pivot joint.

5. The lighting device system of claim 4, wherein the mounting bracket is configured to connect to the panel or the base for sliding movement between a first bracket position and a second bracket position as the at least one movable biasing device is moved between the first position and the second position, respectively, wherein the mounting bracket is located closer to the opening in the second bracket position relative to the first bracket position.

6. The lighting device system of claim 5, further comprising at least one rail on the panel or the base, wherein the mounting bracket has at least one flange that is held by the rail for sliding movement between the first bracket position and the second bracket position.

7. The lighting device system of claim 5, further comprising a pair of rails on the panel or the base, wherein the mounting bracket has a pair of flanges that are held by the rails for sliding movement between the first bracket position and the second bracket position.

8. The lighting device system of claim 1, wherein the at least one movable biasing device comprises a biasing member configured to apply the bias force, the biasing member having a curved surface that matches a curved outer surface of the at least one lighting device module such that the at least one lighting device module fits at least partially within the curved surface of the biasing member when the biasing member applies the bias force.

9. The lighting device system of claim 1, wherein the at least one lighting device module includes:

a module housing having an inner volume and an axial dimension;

a moveable heat sink member; and a light source coupled to the moveable heat sink member for movement with the moveable heat sink member;

wherein the movable heat sink member is supported within the inner volume of the module housing for movement through a range of positions to selectively change an angle at which the light source is directed relative to the axial dimension of the module housing.

10. The lighting device system of claim 9, further comprising at least one angle indicator that provides a visual indication of the angle at which the light source is directed relative to the axial dimension of the module housing.

11. The lighting device system of claim 10, wherein the at least one angle indicator comprises at least one slot shaped opening on the module housing through which at least a portion of the moveable heat sink member is viewable through the range of positions of the moveable heat sink member.

12. The lighting device system of claim 11, wherein the moveable heat sink member is supported for movement along a curved path of motion, and wherein the at least one slot shaped opening comprises a curved slot having a curvature that matches the curved path of motion.

13. The lighting device system of claim 11, further comprising indicia on or adjacent the at least one slot shaped opening that identifies multiple possible angles within a range of angles corresponding to the range of positions of the moveable heat sink member.

14. The lighting device system of claim 9, wherein:

the module housing includes at least one rail within the inner volume;

the moveable heat sink member has at least one groove or channel that receives the at least one rail and is slidable along the at least one rail through the range of positions to selectively change the angle at which the light source is directed relative to the axial dimension of the module housing.

15. The lighting device system of claim 14, wherein the at least one rail has an arch shape to guide the movable heat sink member in an arch-shaped path of movement.

16. The lighting device system of claim 1, further comprising:

a mounting bracket having a receptacle holding the driver electronics, the mounting bracket being configured to connect to the panel or the base for selective sliding movement between a first bracket position and a second bracket position, wherein the receptacle of the mounting bracket is located closer to the opening in the second bracket position relative to the first bracket position to allow or improve access to the driver electronics.

17. The lighting device system of claim 16, wherein:

the at least one movable biasing device is arranged between the opening and the mounting bracket when the at least one movable biasing device is in the first position, and the at least one moveable biasing device is arranged in a location that is not between the opening and the mounting bracket when the at least one movable biasing device is in the second position.

18. The lighting device system of claim 16, further comprising at least one rail on the panel or the base, wherein the mounting bracket has at least one flange that is held by the rail for sliding movement between the first bracket position and the second bracket position.

19. The lighting device system of claim 16, wherein the at least one lighting device module comprises:

a moveable heat sink member;

a light source coupled to the moveable heat sink member for movement with the moveable heat sink member;

a module housing having an inner volume and an axial dimension, the moveable heat sink member being supported within the inner volume of the module housing for movement through a range of positions to selectively change an angle at which the light source is directed relative to the axial dimension of the module housing; and at least one angle indicator that provides a visual indication of the angle at which the light source is directed relative to the axial dimension of the module housing.

* * * * *